US007905363B2

(12) United States Patent
Aarts

(10) Patent No.: US 7,905,363 B2
(45) Date of Patent: Mar. 15, 2011

(54) PRESENTATION APPARATUS

(75) Inventor: Guido Maurinus A. M. Aarts, Drunen (NL)

(73) Assignee: TwinSeal Systems, B.V., Tilburg (NL)

( * ) Notice: Subject to any disclaimer, the term of this patent is extended or adjusted under 35 U.S.C. 154(b) by 0 days.

(21) Appl. No.: 11/739,857

(22) Filed: Apr. 25, 2007

(65) Prior Publication Data

US 2007/0251898 A1 Nov. 1, 2007

(30) Foreign Application Priority Data

Apr. 25, 2006 (NL) ..... 1031678

(51) Int. Cl.
*A47F 5/08* (2006.01)

(52) U.S. Cl. ..... 211/57.1

(58) Field of Classification Search ..... 211/57.1, 211/59.1, 85.5, 44, 59.2, 85.9; 248/220.31
See application file for complete search history.

(56) References Cited

U.S. PATENT DOCUMENTS

| | | | | | |
|---|---|---|---|---|---|
| 613,760 | A | * | 11/1898 | Cronin | 242/131.1 |
| 2,100,421 | A | * | 11/1937 | Wupper | 273/265 |
| 2,100,935 | A | * | 11/1937 | Black | 34/104 |
| 3,337,158 | A | * | 8/1967 | Ball | 242/139 |
| 3,409,141 | A | * | 11/1968 | Cunningham, Jr. et al. | 211/85.5 |
| 3,552,693 | A | * | 1/1971 | Scherf | 242/131 |
| 3,966,221 | A | * | 6/1976 | Beam et al. | 280/79.3 |
| 4,027,799 | A | * | 6/1977 | Stucker | 211/13.1 |
| 4,066,169 | A | * | 1/1978 | Hochman | 211/57.1 |
| 4,286,764 | A | * | 9/1981 | Pfeifer | 248/220.22 |
| 4,742,923 | A | * | 5/1988 | Calvert | 211/57.1 |
| 4,783,033 | A | * | 11/1988 | Valiulis | 248/220.22 |
| 4,850,557 | A | * | 7/1989 | Valiulis | 248/220.22 |
| 5,388,709 | A | * | 2/1995 | Adams | 211/70.6 |
| 5,626,243 | A | * | 5/1997 | Brozak, Jr. | 211/59.1 |
| 5,688,098 | A | * | 11/1997 | Theno | 414/277 |
| 5,855,282 | A | * | 1/1999 | Hardy | 211/59.1 |
| 6,811,128 | B1 | * | 11/2004 | Wagner et al. | 248/220.31 |
| 7,032,755 | B2 | * | 4/2006 | Martins | 206/461 |
| 7,051,984 | B2 | * | 5/2006 | Botkin | 248/220.31 |
| 2004/0140277 | A1 | * | 7/2004 | Comartin et al. | 211/59.1 |
| 2005/0103730 | A1 | * | 5/2005 | Hosilyk | 211/85.5 |

FOREIGN PATENT DOCUMENTS

| | | |
|---|---|---|
| FR | 815 488 | 7/1937 |
| WO | WO 98/42241 | 10/1998 |

OTHER PUBLICATIONS

English abstracts of WO 98/42241.

* cited by examiner

*Primary Examiner* — Jennifer E. Novosad

(57) ABSTRACT

A presentation apparatus, provided with a series of suspension elements with a longitudinal direction, fixed to a wall element near a first end and provided with a presentation element at an opposite end, wherein, from at least one suspension element, a series of rolls of tape is suspended by sliding these over the suspension element by an opening in a core, wherein the presentation element of the respective suspension element has a frontal surface which, in front view, extends at least partly above the top side of the suspension element and has such a size and shape that a roll can be slid from the suspension element over said presentation element.

13 Claims, 2 Drawing Sheets

PRESENTATION APPARATUS

RELATED APPLICATION

This application claims the benefit of the filing date of Dutch application no. 1031678, filed Apr. 25, 2006 which is hereby incorporated herein by reference in its entirety for all purposes.

FIELD

The invention relates to a presentation apparatus for rolls of tape.

BACKGROUND

Rolls of tape are typically suspended in display apparatuses or stacked on shelves on pins in packages such as a blister pack with Euro Lock openings. Such packages are relatively expensive and awkward and, in addition, not particularly environment-friendly. In addition, with use of shelves, there is the risk that the presentation becomes less attractive due to dirtiness, such as dust. Further, display apparatuses and in particular shelves take up relatively much space.

SUMMARY

The invention contemplates providing a presentation apparatus for use in, for instance, stores or companies, where an attractive appearance is obtained, information can simply be given and, in addition, the available space can be utilized in an adequate manner. To this end, a presentation apparatus according to the invention is characterized by the measures of claim 1.

With an apparatus according to the invention, rolls of tape are slid over suspension elements such as pins or brackets which are suspended by a first end, for instance to a wall board or other wall element, such as a Tegometall® rack. This allows particularly simple fixing, in any desired position, both next to one another and one above the other. Each suspension element has a presentation element provided near a second end and extending slightly above a top side of the suspension element, viewed in front view, so that rolls suspended from the suspension element with the aid of a central opening cannot slide over the second end, without slightly being lifted.

Each presentation element preferably has a shape and dimensions which are chosen such that a relatively large frontal surface has been obtained for, for instance, information about the tape, such as logos, price and the like, while the rolls can still relatively simply be lifted with above-mentioned opening over the presentation element.

With a presentation apparatus according to the invention, rolls of tape can be suspended while being unpackaged, while unintentional disengagement of the rolls is simply prevented and still sufficient information about the rolls can be given. In addition, relatively many rolls can be provided on, at least above a square meter of floor surface.

In an advantageous embodiment, the suspension elements incline slightly downwards from the first end, so that the respective presentation element is provided on or near the lowest point, so that rolls suspended from the suspension element are pressed against one another and against the presentation element by gravity. Thus, irrespective of the number of rolls on the suspension element, the first roll will always rest against the presentation element, so that a pleasant appearance is obtained and, in addition, the removal is simplified.

The angle at which the suspension elements incline can be chosen as desired. Preferably, it is so large that the gravity will simply and surely make the rolls move down, also if few or heavy rolls are suspended, and so small that optimal use can be made of the space. It has been found that angle between 2 and 45 degrees is advantageous for most rolls, an angle between 2 and 30 degrees being preferred. Thus, for instance, an angle between 5 and 20 degrees can be chosen.

Because the rolls are suspended from the suspension elements, they will always be suspended so as to be relatively level with a top side irrespective of the size, so that a calm and pleasant appearance is still further enhanced.

BRIEF DESCRIPTION OF THE DRAWINGS

By way of illustration, an embodiment of a presentation apparatus according to the invention will be shown and described with reference to the drawing, in which.

DETAILED DESCRIPTION

The embodiments shown should not be taken as being limitative in any way. They only serve to illustrate the general idea of the invention.

Figure 1:
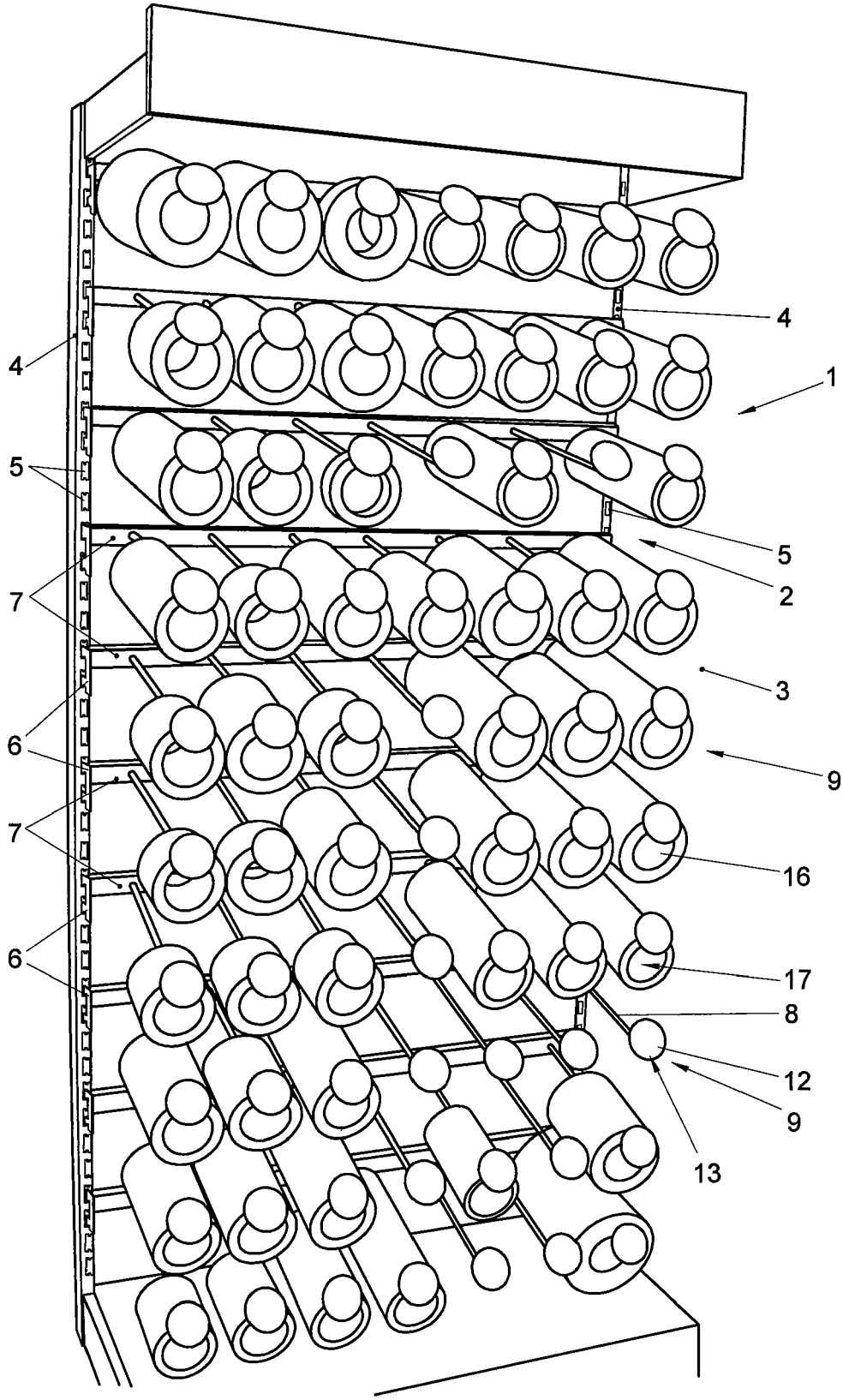
FIG. 1 shows, in perspective front view, a presentation apparatus according to the invention.

FIG. 1 shows, in perspective view, a presentation apparatus 1 according to the invention, which is suspended from a Tegometall rack 2, which is known per se. This comprises two rails 4 suspended approximately vertically against a wall 3, with a regular pattern of openings 5 in which brackets 6 or the like can be suspended with hooks. In this embodiment, each bracket comprises a strip 7, for instance from steel or plastic, which extends parallel to the wall 3, for instance horizontally, between the two rails or in front thereof. On each strip 7, a series of pins 8 is fixed, as a basis for the suspension elements 9. Each pin 8 is, for instance, manufactured from steel or plastic and is fixed to the strip 7 by a first end 10. The pin 8 has a longitudinal direction L and is, at the second end 11, provided with a presentation element 12 which is disc-shaped in this embodiment, for instance a substantially circular shield, on which information can be provided on a front side 13, for instance logo, price, information for use and the like.

Figure 2:
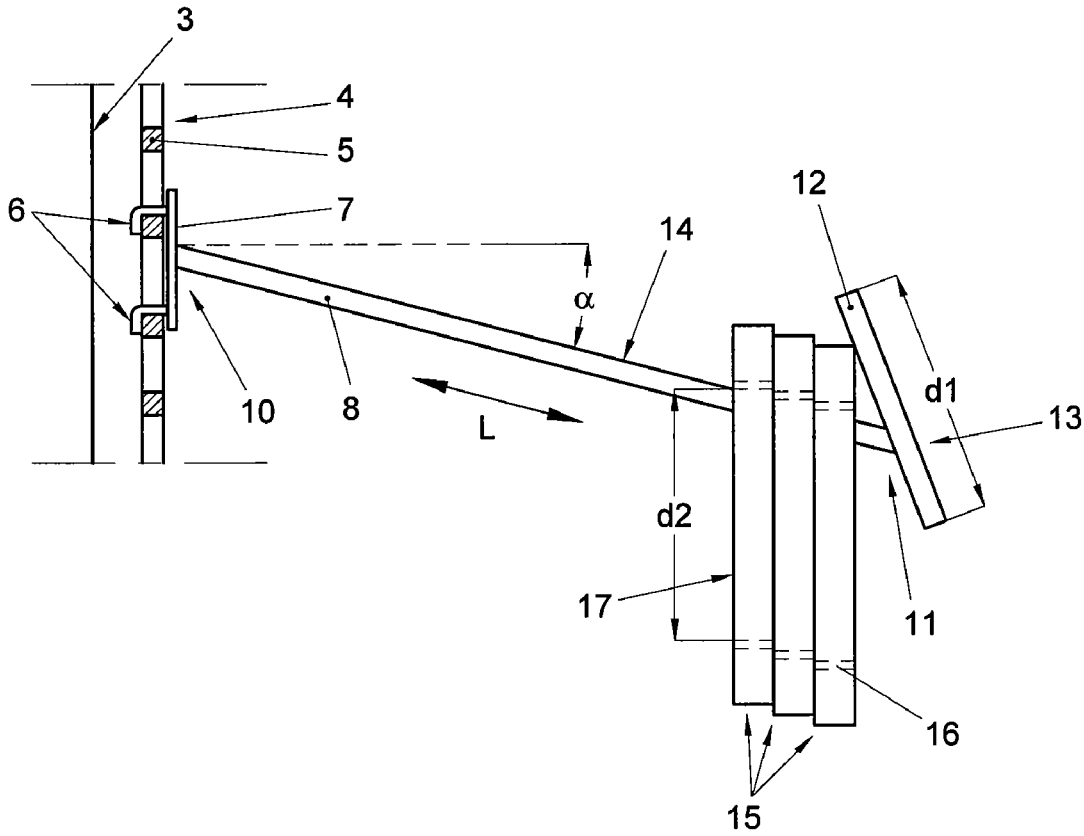
FIG. 2 schematically shows, in side elevational view, a suspension element with a series of rolls and a presentation element.

As clearly appears from FIG. 2, the or each pin 8 inclines downwards in the direction of the second end 11, so that the presentation element 12 is located near the lowest point. The presentation element 12 is then fixed such that, in front view and side elevational view, it extends slightly above a top side 14 of the pin 8. Optionally, the presentation element may incline slightly backwards, so that information on the front side 13 is still better visible.

From the pin 8, a series of rolls 15 of tape is suspended, which rest on above-mentioned top side 14 and are forced downwards along the pin 8, against one another and against the presentation element 12, by gravity. Thus, from a viewpoint of a user, they are always suspended near the front side of the pin, that is to say the free end thereof. That means that they are always well visible and can be grasped well, that the presentation apparatus offers a pleasant, calm appearance and that the rolls still cannot slide from the pin 8.

The pins are preferably finished so as to be particularly smooth and may, for instance, have a smooth coating.

In the embodiment shown, the rolls of tape 15 have a core 16 which is substantially cylindrical with a round continuous opening 17 (shown in dotted lines in FIG. 2). In this embodiment, the presentation element 12 has a shape which is also approximately circular having a diameter d1. The diameter d2 of the opening 17 is slightly smaller than the diameter d1, for instance between 2 and 30% smaller, so that a relatively large surface is obtained for information and the rolls are stopped adequately, while the rolls can still be removed relatively simply from the pin 8 and can be slid over the presentation element 12. Preferably, the difference in diameters is approximately between 1 and 20%. For a roll having a diameter opening of 6 cm, for instance, a shield 12 having a diameter of 5-5.5 cm would be usable. The shapes and dimensions may of course be chosen as desired. In addition, different sizes of rolls will offer a calmer appearance than, for instance, on shelves.

It will be clear that non-round shapes may also be used in the rolls but particularly also for the presentation elements. It then again holds that the dimensions and shapes thereof can be geared to one another, so that the rolls cannot slip from the pins easily but can be lifted.

Since the rolls 15 can be kept on the pins without packages, the presentation apparatus is relatively inexpensive in use and still it offers a pleasant appearance. Larger rolls of tape will become suspended approximately level with smaller rolls, at least with a top side, because the openings thereof will always rest on the same top side of a pin, which offers a still calmer appearance.

By providing a number of strips with pins one above the other and/or next to one another, a matrix of pins can be obtained, which still further improves the use of space.

Variations within the framework of the invention set forth in the claims will be readily apparent to a skilled person. Examples thereof are, for instance, that the suspension elements may be other than pin-shaped, for instance strips. The pins or other suspension elements may be fixed other than to a wall or other wall element. They may also be combined with other suspension elements for other products. These and other variations are also understood to be disclosed herein.

The invention claimed is:

1. A presentation apparatus comprising a series of suspension elements with a longitudinal direction, fixed to a wall element near a first end and provided with a presentation element at an opposite end, wherein, from at least one suspension element, a series of rolls of tape is suspended by the suspension element extending through openings in cores of the rolls of tape and with one of the rolls of tape resting against the presentation element, wherein the presentation element of the respective suspension element has a frontal surface with information displayed thereon which, in front view, extends at least partly above the top side of the suspension element and has such a size and shape that a roll of tape can be slid from the suspension element over said presentation element.

2. The presentation apparatus according to claim 1, wherein the presentation element is inclined backwards relative to the suspension element.

3. The presentation apparatus according to claim 2, wherein the longitudinal direction of at least one suspension element operatively includes an angle with a horizontal line, drawn from the first end, such that the suspension element inclines downwards from the first end between 2 and 45 degrees.

4. The presentation apparatus according to claim 2, wherein said angle is between 2 and 30 degrees.

5. The presentation apparatus according to claim 2, wherein said angle is between 5 and 20 degrees.

6. The presentation apparatus according to claim 1, wherein the rolls of tape on the suspension element slide against one another and against the presentation element under the influence of gravity.

7. The presentation apparatus according to claim 1, wherein the presentation element has a frontal surface having dimensions smaller than those of said opening.

8. The presentation apparatus according to claim 1, wherein the presentation element has a substantially circular frontal surface with the diameter of the frontal surface being smaller than the diameter of the opening in one or more rolls.

9. The presentation apparatus according to claim 8, wherein said frontal surface has a diameter which is between 1 and 30% smaller than said opening.

10. The presentation apparatus according to claim 8, wherein said frontal surface has a diameter which is between 1 and 20% smaller than said opening.

11. The presentation apparatus according to claim 1, wherein the suspension element is bar-shaped.

12. The presentation apparatus according to any claim 1, wherein a matrix of suspension elements is provided.

13. The presentation apparatus according to claim 1, wherein the rolls are capable of being slid on the suspension elements while being unpackaged.

* * * * *